US005395430A

United States Patent [19]

Lundgren et al.

[11] Patent Number: 5,395,430

[45] Date of Patent: Mar. 7, 1995

[54] ELECTROSTATIC PRECIPITATOR ASSEMBLY

[75] Inventors: Dale A. Lundgren, Gainesville, Fla.; Virgil A. Marple, Maple Plain, Minn.; Robert A. Herrick, Raleigh, N.C.

[73] Assignee: Wet Electrostatic Technology, Inc., Maple Plain, Minn.

[21] Appl. No.: 276,761

[22] Filed: Jul. 18, 1994

Related U.S. Application Data

[63] Continuation of Ser. No. 43,832, Apr. 6, 1993, abandoned, which is a continuation-in-part of Ser. No. 16,717, Feb. 11, 1993, abandoned.

[51] Int. Cl.[6] ..... B03C 3/41; B03C 3/49

[52] U.S. Cl. ..... 96/83; 96/95; 96/98

[58] Field of Search ..... 96/52, 53, 68, 70, 83, 96/84, 95, 97, 98; 95/65, 78

[56] References Cited

U.S. PATENT DOCUMENTS

| | | | |
|---|---|---|---|
| 1,339,480 | 5/1920 | Schmidt | 55/13 |
| 2,709,497 | 5/1955 | Phyl | 55/119 |
| 2,751,036 | 6/1956 | Busfield | 55/119 |
| 2,814,360 | 11/1957 | Beaver | 55/8 |
| 2,853,150 | 9/1958 | Lenehan | 55/119 |
| 3,395,193 | 7/1968 | Bruce et al. | 585/539 |
| 3,400,513 | 9/1968 | Boll | 55/103 |
| 4,072,477 | 2/1978 | Hanson et al. | 55/10 |
| 4,194,888 | 5/1980 | Schwab et al. | 55/2 |
| 4,247,307 | 1/1981 | Chang | 96/75 X |

*Primary Examiner*—Richard L. Chiesa
*Attorney, Agent, or Firm*—Bell, Seltzer, Park & Gibson

[57] ABSTRACT

An electrostatic precipitator assembly is disclosed. The assembly includes a tubular collector and an electrode suspended therein. The electrode includes a substantially cylindrical collector portion and a charging portion which includes a rod and a charging disk, wherein the gap between the charging disk and the collector is at least as great as the gap between the collector portion of the electrode and the collector.

11 Claims, 5 Drawing Sheets

ELECTROSTATIC PRECIPITATOR ASSEMBLY

RELATED APPLICATIONS

This is a continuation of application Ser. No. 08/043,832, filed on Apr. 6, 1993, now abandoned, which is a continuation-in-part of application Ser. No. 08/016,717, filed Feb. 11, 1993, now abandoned, and entitled ELECTROSTATIC PRECIPITATOR ASSEMBLY, the entirety of which is incorporated herein by reference.

FIELD OF THE INVENTION

This invention relates generally to electrostatic precipitators that remove particulate matter from a gas stream, and more particularly relates to an electrostatic precipitator having separate charging and collection chambers served by a single power supply.

BACKGROUND OF THE INVENTION

The use of electrostatic precipitators to remove particulate matter from a fluid stream is known. See, e.g., U.S. Pat. No. 4,247,307 to Chang, U.S. Pat. No. 4,194,888 to Schwab et al. Typically, an electrostatic precipitator comprises a charged electrode, generally a straight wire, contained within grounded collector plates or pipes. Ionized particles are drawn by the electric field created between the electrode and the collectors. Particularly popular of late are "wet" electrostatic precipitators, in which a flow of a cleaning fluid, such as water, is maintained over the collector plates which washes away the particulates as they collect on the collectors. This eases the cleaning process, but also improves electrical conduction of the collectors.

Chang et al. describes a single stage precipitator which includes an electrode having regularly spaced round plates that are fixed perpendicularly to a conventional wire. This creates separate and alternating charging and collection sections of the electrode; the charging sections being in the cross sections of the precipitator in the immediate vicinity of a plate, and the collection sections being in the cross-sections somewhat removed from a plate (i.e., along the portions of wire between plates). This type of precipitator can be driven by a single power source; however, because the wire is considerably farther from the collector surface than the plates, the electric field in the collection sections is much weaker than that in the charging sections. This alternating arrangement of small crosssections having a strong electric field with large cross-sections having a considerably weaker electric field is somewhat inefficient and requires a relatively long series of collection sections in order to remove an acceptable percentage of particles from the stream. Schwab discloses a similar configuration, but includes a series of plates which increase in diameter toward the downstream end of the electrode in an attempt to improve collection efficiency. Others have utilized separate charging and collection zones driven by separate power sources in an attempt to address the problem.

In view of the foregoing, it is an object of this invention to provide a single power source electrostatic precipitator with improved collection efficiency.

It is a further object of the present invention to provide a single power source electrostatic precipitator that can be fitted easily into existing flue gas decontamination streams.

SUMMARY OF THE INVENTION

These and other objects are satisfied by the present invention, which as a first aspect includes an electrostatic precipitator unit comprising tubular collection means, an electrode suspended within the tubular collection means, and power means electrically connected to the electrode. The electrode comprises a substantially cylindrical collector portion which is suspended substantially perpendicularly to the longitudinal axis of the collection means and a charging portion which includes a rod extending perpendicularly to the longitudinal axis of the collection means with perpendicular disks emanating therefrom. The gap between the inner surface of the collection means and the outer surface of the collector portion of the electrode is substantially the same width or less than the gap between the peripheral edge of the disk means and the inner surface of the collection means. Preferably, the disk means comprises a plurality of circular disks, and the collection means includes a substantially cylindrical inner surface.

DETAILED DESCRIPTION OF THE PREFERRED EMBODIMENT

The present invention will now be described more particularly hereinafter with reference to the accompanying drawings, in which a preferred embodiment of the invention is shown. The invention can, however, take many forms and should not be construed as limited to the embodiment set forth herein; rather, applicants provide this embodiment so that this disclosure will be thorough and complete, and will convey the scope of the invention to those skilled in this art.

The invention relates to the removal of particulate matter from a flowing gas stream. The stream enters through an inlet, passes through a number of the components described below, and exits through an outlet, thus defining a directed flow path. As used herein to describe the relationship between components of the invention, the term "upstream" is intended to mean that a particular component is located along the flow path nearer to the inlet than is the other component of interest. Conversely, the term "downstream" is intended to mean that a particular component is located along the flow path nearer to the outlet than is the other component of interest.

Figure 1:
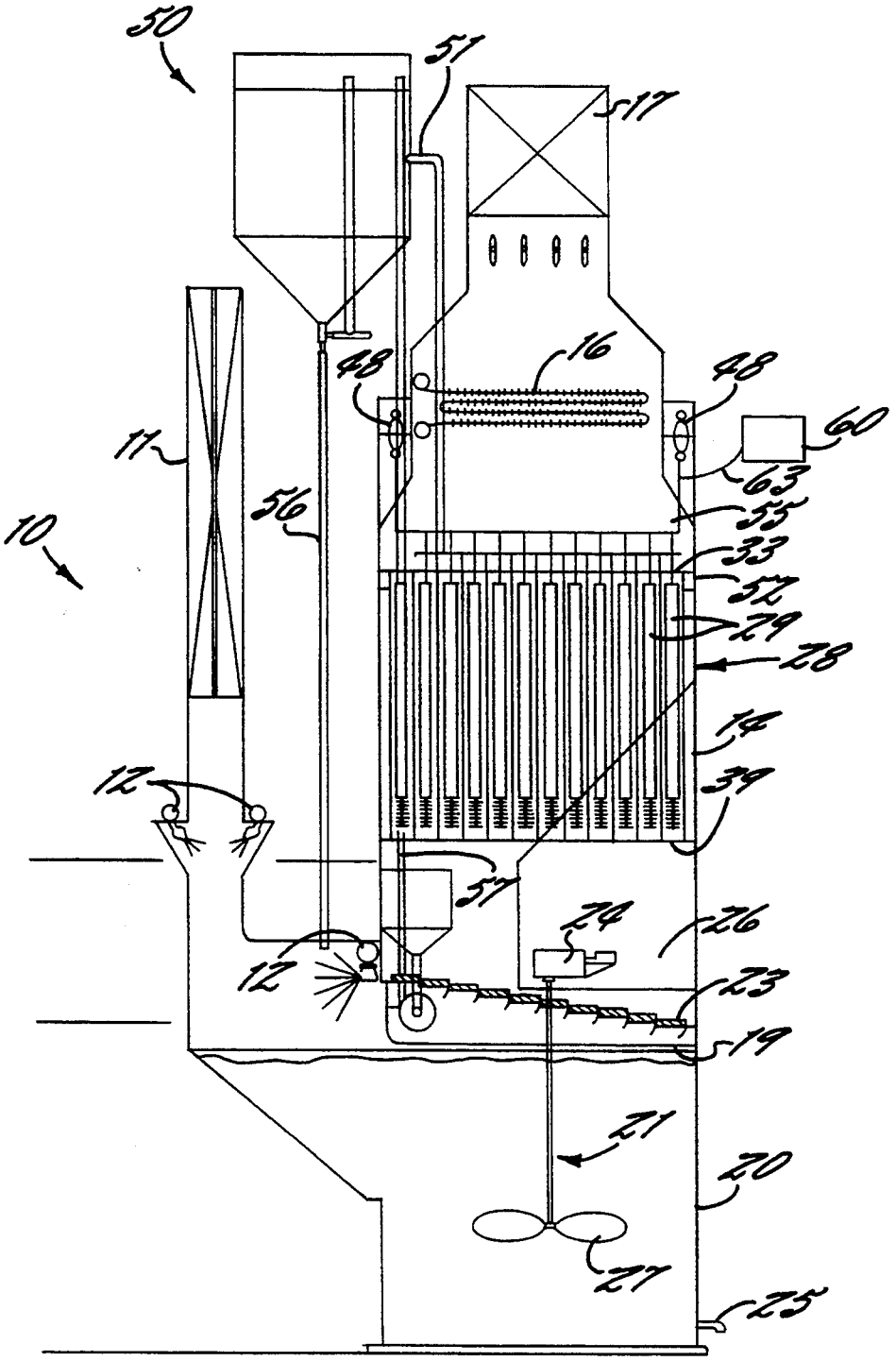
FIG. 1 is a cross-sectional side view of a flue gas scrubber spray tower which contains therein an electrostatic precipitation unit.

Referring now to the drawings, a flue gas scrubber spray tower, broadly designated at 10, is shown in FIG. 1. The cleaning unit 10 comprises an inlet duct 11, an electrostatic precipitator unit 28 contained within a housing 14, an outlet duct 17, a cleaning fluid storage tank 20, a power supply unit 60 and a cleaning fluid supply unit 50.

The inlet duct 11 includes three sets of water flow nozzles 12 which introduce cleaning fluid into the gas flow to remove much of the particulate matter and to neutralize certain contaminants. The nozzles 12 are fed by cleaning fluid supply unit 50 through feed conduit 56. A series of baffles 23 are positioned across the downstream end of the inlet duct 11; these baffles 23 distribute gas flow evenly across the electrostatic precipitator unit 28 for more efficient particle collection. Catch basin 19 is positioned beneath the baffles 23 to collect cleaning fluid and return it to cleaning fluid supply 50 by conduit 57.

Directly beneath the downstream end of the inlet duct 11 is the cleaning fluid storage tank 20. A stirrer unit 21, which comprises a propeller 27 that extends into the tank 20 and a motor 24, is attached to the housing 14 by a mounting case 26.

The housing 14 of the electrostatic precipitator unit 28 is attached at its upstream end to the downstream end of the inlet duct 11. The electrostatic precipitator unit 28 comprises a downstream tube sheet 33, an upstream tube sheet 39 and a plurality of individual electrostatic precipitators 29, each of which comprises a collector tube 30 and an electrode 40.

Figure 3:
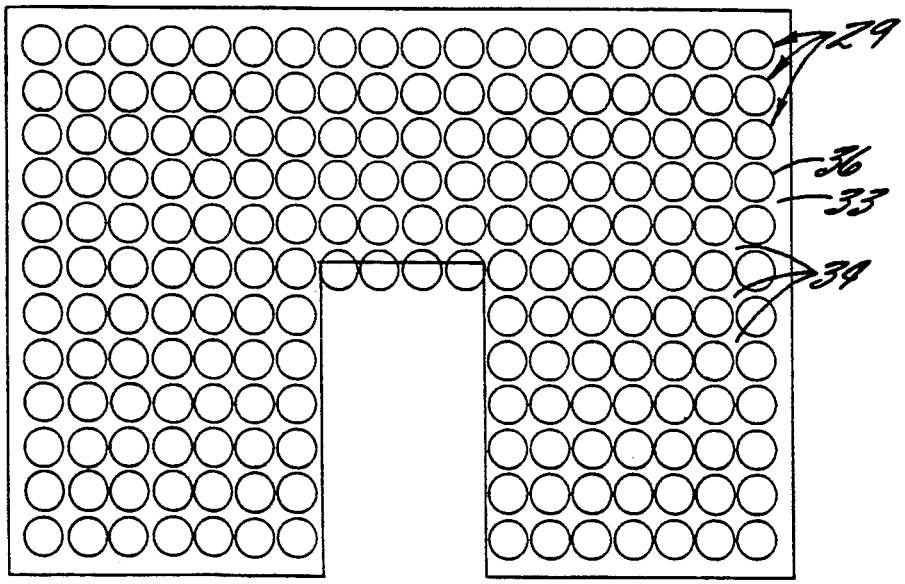
FIG. 3 is a plan view of an array of collector tubes within a tube sheet.

As seen in FIG. 3, the individual electrostatic precipitators 29 are arranged in an array of perpendicular rows and columns. The collector tubes 30 are secured at their downstream ends 36 by the downstream tube sheet 33. The downstream tube sheet 33 comprises a flat sheet having apertures sized and positioned to mate with the downstream ends of the collector tubes 30; the result is a series of interconnected diamond-shaped plates 34 which join and secure adjacent collector tubes 30. The peripheral edges of the upper tube sheet 33 are secured at the downstream end of the housing 14. The upstream tube sheet 39 has essentially the same form as the downstream tube sheet 33, but secures the upstream ends of the collector tubes 30 to the upstream end of the housing 14.

Figure 2:
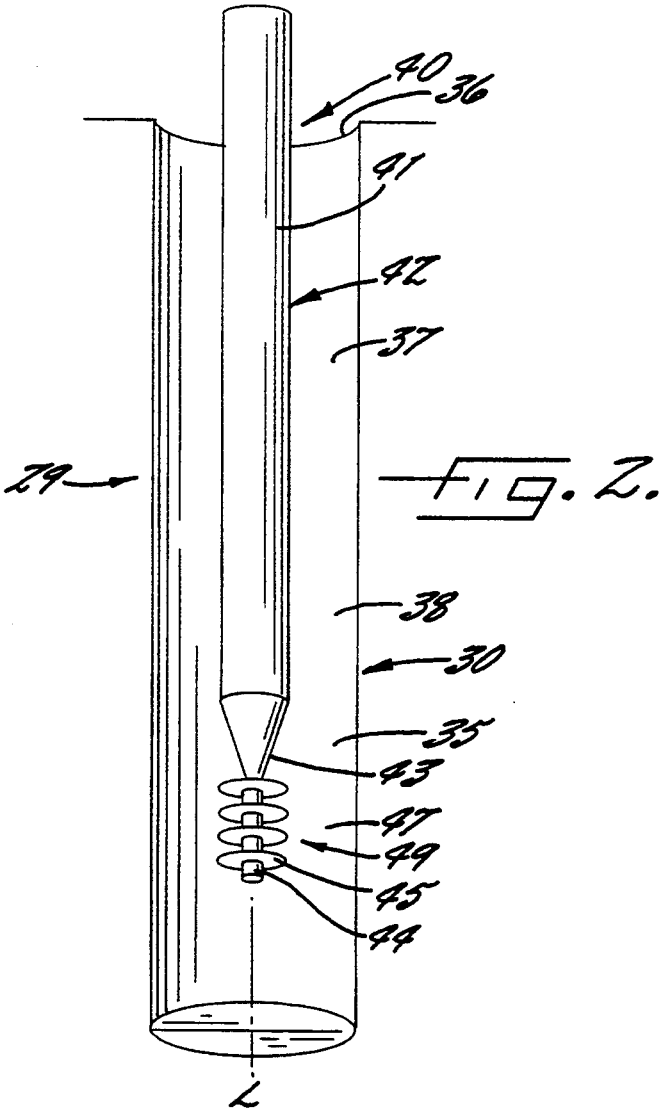
FIG. 2 is a cross-sectional perspective view of a single collector tube and electrode.

Each of the individual electrostatic precipitators 29 (FIG. 2) is virtually identical in form and comprises a collector tube 30 and an electrode 40 suspended within. For clarity and brevity of description, only one electrostatic precipitator 29 will be described in detail; those skilled in this art will appreciate that this description applies equally to the others as well.

The collector tube 30 is an elongated cylinder extending from the upstream tube sheet 39 to the downstream tube sheet 33. The collector tube 30 has an inner surface 38, embodied herein as a hollow cylinder, which surrounds a lumen 35 having a longitudinal axis L. Those skilled in this art will recognize that any tubular means, such as tubes having an inner surface with a cross-section that is square, triangular, hexagonal, elliptical, and the like, that surrounds the electrode 40 without making contact thereon is suitable for use in the present invention. Through its attachment with the tube sheets 33 and 39, which are attached to the housing 14, the collector tube 30 is electrically grounded. Although a metal such as aluminum or stainless steel is preferred for durability and availability, the collector tube 30 can be made of any material, such as polyvinyl chloride, which, when flushed with a conductive cleaning fluid, creates an electrical field between itself and an electrically charged electrode 40.

Figure 5:
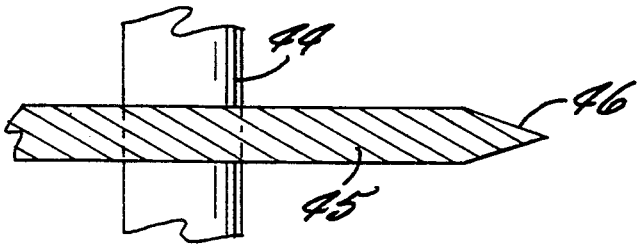
FIG. 5 is an enlarged cross-sectional view of a charging disk.

Still looking at an individual electrostatic precipitator unit 29, the electrode 40, which is suspended from a electrode suspension frame 55, is positioned within the lumen 35 of the collector tube 30. The electrode 40 is suspended therein so that no portion of the electrode 40 contacts the inner surface 38 of the collector tube 30. The electrode 40 comprises a downstream collector portion 41, a tapered portion 43, and an upstream charging portion 49. The collecting portion 41 has a substantially cylindrical circumferential surface 42 and a longitudinal axis which coincides with the longitudinal axis L of the lumen 35 of the collector tube 30. Suspension of the electrode 40 within the lumen L of the collector tube 30 creates a collection gap 37 between the outer surface 42 of the electrode 40 and the inner surface 38 of the collector tube 30. In this embodiment, the gap is substantially uniform in width for all points on the outer surface 42. However, those skilled in this art will appreciate that the gap can be of nonuniform width, such as where the longitudinal axis of the collecting portion 41 is not coincident with the longitudinal axis of the collector tube 30, where the outer surface 42 of the electrode 40 or the inner surface 38 of the collector tube 30 is tapered, and the present invention will still be operable. As used herein, the minimum collection gap is the minimum distance between any point on the outer surface 42 of the electrode 40 and any point on the inner surface 38 of the collector tube 30. Preferably the minimum collection gap is between about 1.5 and 5 inches. The charging portion 49 of the electrode 40 comprises a tapered section 43, a rod 44 and four disks 45, although it is to be understood that any number of disks can be included. The downstream end of the tapered portion 43 is attached to the upstream end of the collector portion 41; the upstream end of the tapered portion 43 is attached to the downstream end of rod 44. Those skilled in this art will appreciate that, although the inclusion of a tapered portion 43 is preferred for reduced arcing, the present invention is also operable with the rod 49 attached directly to the collector portion 41. The longitudinal axis of the rod 44 coincides with the longitudinal axis L of the collector portion 41. The four circular disks 45 are fixed substantially normally to the rod 44; those skilled in this art will appreciate that although a smoothly curved disk is preferred, and a circular disk is particularly preferred, the disk 45 can take any shape, such as square, triangular, hexagonal, octagonal, or the like, and still be suitable for use with the present invention. As illustrated in FIG. 5, it is preferred that each disk 45 be tapered at the peripheral edges 46.

Each disk is sized and positioned on the rod 44 so that its peripheral edge 46 does not contact the inner surface 38 of the collector tube 30; thus a charging gap 47 is created between the peripheral edge 46 and the inner surface 38 of the collector tube 30. As used herein, the minimum charging gap is the minimum distance between any point on the peripheral edge of any disk 45 and any point on the inner surface 38 of the collector tube 30. Preferably, the charging gap is between about 1.5 and 5 inches. The minimum charging gap should be substantially the same width or greater than the minimum collection gap. It is particularly preferred that the ratio of the diameter of the collector portion 41 be between about 0.75:1 and 1:1. In this configuration, the electric field created by the charged electrode 40 is similar in strength in the collection gap 37 and in the charging gap 47. Corona discharge, necessary for particle charging, occurs preferentially in the charging gap 47 due to the presence of edges 46 on the periphery of the disks 45. The electric field in the collection gap 37 is substantially constant over the entire length of the outer surface 42 of the collector portion 41. The configuration of the present invention provides an electrostatic precipitator in which charged particles are subjected to a strong migration gradient over a large portion of the collection tube 30 and therefore improves collection efficiency of the precipitator for a given gas flow length.

The electrodes 40 can be formed from any conductive material, such as aluminum, stainless steel, copper, iron, or the like, which is sufficiently electrically conductive to become charged when energized by a power source and thereby create an electric field across the collection gap 37 and the charging gap 47. Preferably, the electrodes are formed of stainless steel or aluminum.

As noted above, the electrodes 40 are suspended within the lumens 35 of the collector tubes 30 from an electrode suspension frame 55. The suspension frame 55 is attached to the housing 14 through a plurality of insulator posts 48 which electrically insulate the electrodes 40 from the collector tubes 30. The suspension frame 55 is electrically connected to a power supply 60 through a cable 63. The magnitude of the voltage applied to the electrodes 40 from the power supply 60 depends on, inter alia, the tendency for corona discharge (arcing) to occur between the electrode 40 and the collection tube 30. The power supplied to the electrode 40 by the power supply 60 is preferentially selected to be some value that causes corona discharge in the charging gap 47, but does not do so in the collection gap 37.

Those skilled in this art will understand that the power supply 60 can be any DC power means that can create a potential difference across and thus an electric field within the collection gap 37 and the charging gap 47. While the present invention is operable with any potential difference created across the collection and charging gaps, preferably the power supply is capable of creating a potential difference of between about 10,000 and 25,000 volts per inch of collector gap width, and more preferably is capable of creating a potential difference of about 20,000 volts per inch of collector gap width.

Figure 4:
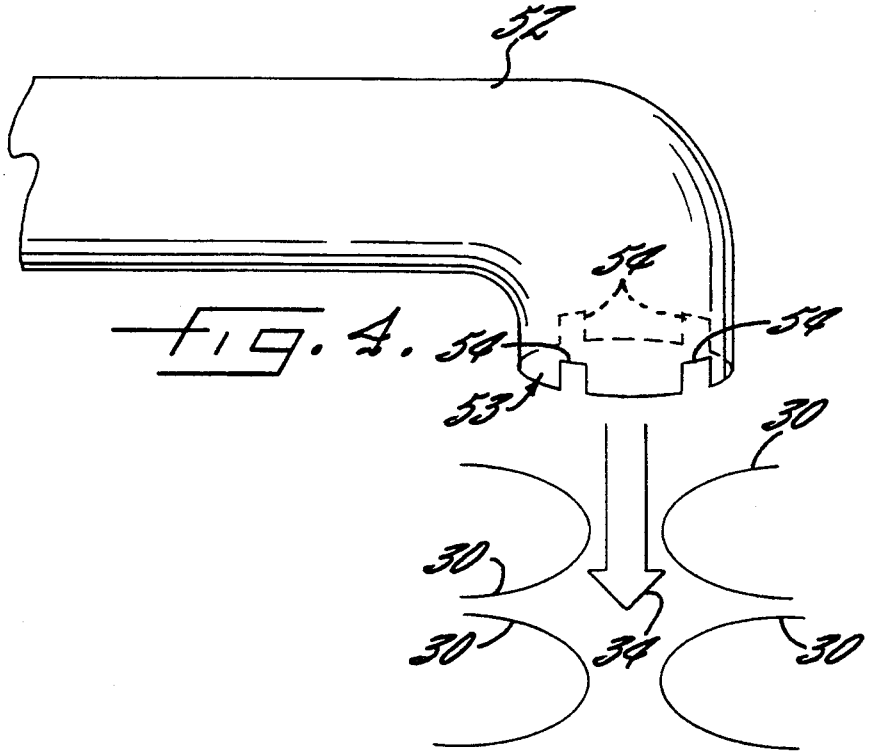
FIG. 4 is a perspective view of the outlet of a cleaning fluid branch.

A cleaning fluid supply system 50 is connected to the housing 14 by a fluid supply conduit 51. The conduit 51 feeds a plurality of branches 52, each of which leads to a diamond-shaped plate 34 of the downstream tube sheet 33 (FIG. 4). At the outlet 53 of each of the branches 52 are four notches 54 spaced circumferentially equally about the branch; these notches 54 are present to provide substantially equivalent flow of cleaning fluid to each collector tube 30. A preferred cleaning fluid is water.

The downstream end of the housing 14 is attached to the upstream end of the outlet duct 17. Secured within outlet duct 17 is an optional reheater 16 which vaporizes cleaning fluid to prevent it from interfering with processes downstream of the outlet duct 17.

Prior to operation, cleaning fluid is pumped from the fluid supply system 50 through the fluid supply conduit 51, into the branches 52, and out each outlet 53 onto the diamond-shaped plates 34 of the upper tube sheet 33. Even distribution of the cleaning fluid in all directions is provided by the notches 54. The cleaning fluid flows across the diamond-shaped plates 34 and is drawn by gravity to the inner surfaces 38 of the collector tubes Concurrently, the electrodes 40 are charged by the power supply 60 so that a potential difference is created across the collection gap 37 and the charging gap 47. In each instance the potential difference across these gaps creates an electric field in the gap which can draw particles ionized in the charging gap 47 to the inner surfaces 38 of the collector tubes 30.

Removal of particulate matter from flue gas begins as the flue gas flows into the inlet duct 11, through the baffles 23, and into the charging gaps 47 of the individual electrostatic precipitators 29. As the particles enter these gaps, they are ionized by the electric field created by the potential difference across the gap. Looking at the operation within a single precipitator 29, ion generation is strongest in the charging gap 47 in the longitudinal cross-sections near the disks 45. Some of the ionized particles can be drawn to the inner surface 38 directly across the charging gap from disks 45. However, most of the particles have sufficient translational momentum to flow through the field created in the charging gap 47 and thus into the collection gap 37. Because the electric field across the collection gap 37 is of substantially constant strength along the length of the collection portion 4 of the electrode 40, the large majority of particles are collected on the inner surface 38 adjacent the collection gap 37. Having been cleaned, the flue gas then exits the downstream ends of the collector gaps 37 and flows into the outlet duct 17, where it is heated by the reheater 16. Once heated, the flue gas exits the outlet duct 17.

Once particles have been collected on the inner surface 38 of a collector tube 30, the contaminants are washed away by the cleaning fluid as it flows gravimetrically upstream to the upstream end of the collector tubes 30. From there the cleaning fluid drips onto the baffles 23, then into the catch basin 19 and conduit 57 for recirculation to the fluid supply system 50. As the water in the cleaning fluid circuit becomes particle-laden, it is fed into the nozzles 12 through feed conduit 56 for delivery to the cleaning fluid tank 20. The propeller 27 of the stirring unit 21 rotates to prevent the contaminants from settling. Periodically, cleaning fluid is drained through the drain 25 to a cleaning facility. Alternatively, the cleaning fluid can be treated after flowing through conduit 57.

Those skilled in this art will recognize that an electrostatic precipitator of the present invention can be utilized in a number of environments in which fine particulate matter is removed from a gas stream, and is particularly applicable when saturated gasses are present in the stream. Exemplary applications include combustion processes outfitted with wet gas cleaning devices, such as municipal incinerators, hazardous waste incinerators, metallurgical processing units, and the like.

Particular embodiments of the invention are set forth in the following illustrative examples. These examples are not intended to be limiting, but rather are included to provide to those skilled in this art a complete description of the invention.

EXAMPLE 1

An electrostatic precipitator unit containing one individual electrode-collector tube assembly was constructed. The assembly included a 16 inch diameter stainless steel tube approximately 16 feet in length which served as collector tube. Within the tube a stainless steel electrode was suspended; the electrode included a 12 foot collection section of 8 inch diameter and a 4 foot wire supporting eight 6 inch disks spaced 6 inches apart. The electrodes were suspended from a frame which was attached to PVC insulators. The electrodes were electrically connected to a 75 KV DC power supply.

The electrode-collector tube assembly was enclosed in a housing attached via an inlet duct to a flue gas scrubber of a power plant boiler. An outlet duct contained a reheater heating the flue gas to above dew point levels. The outlet also included an opacity monitor.

Testing was conducted by supplying the surfaces of the collector tubes with water. Flue gas was diverted into the unit at flow rates of 700, 1,000 and 1,500 cfm. Voltage was varied at 5 KV intervals. Testing was continued for 75 hours, with opacity measurements taken continuously.

EXAMPLE 2

Figure 6:
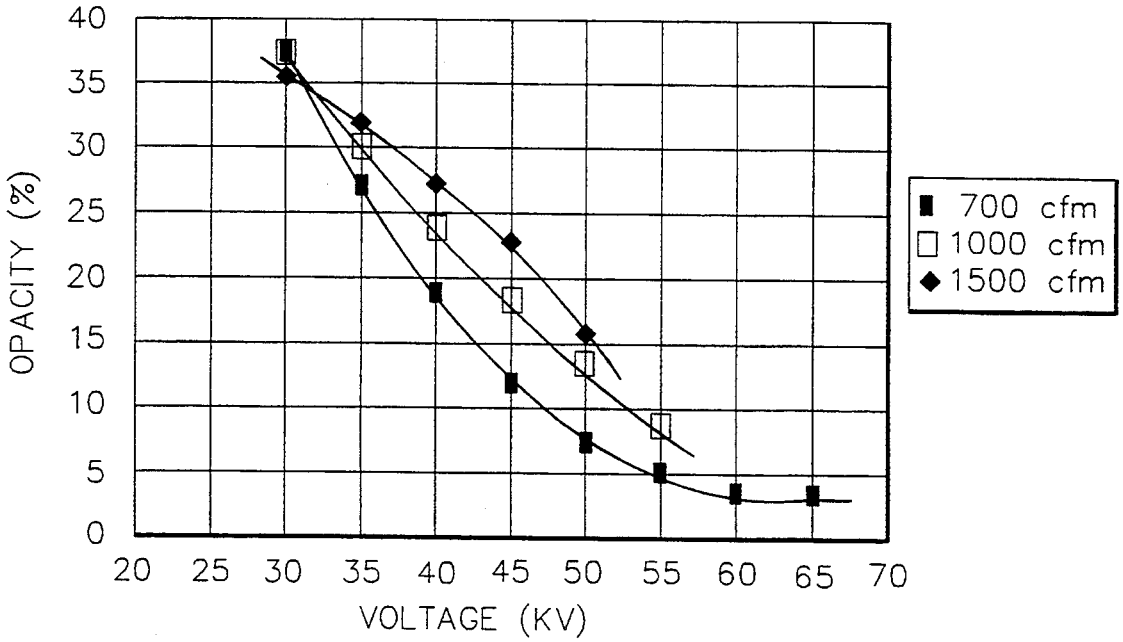
FIG. 6 is a graph showing opacity as a function of collection gap voltage for three different flue gas flow rates for a 16 inch diameter collector tube, an 8 inch collector electrode, and 8 inch diameter ionizing disks.

Average opacity level data obtained from the testing described in Example 1 are shown in FIG. 6. It is seen that opacity varied inversely with voltage across the collection tube and with flue gas flow rate.

EXAMPLE 3

The apparatus of Example 1 was altered to include 8 inch ionizer disks. The testing procedure of Example 1 was repeated, although a flue gas flow rate of 1,250 cfm was also tested.

Figure 7:
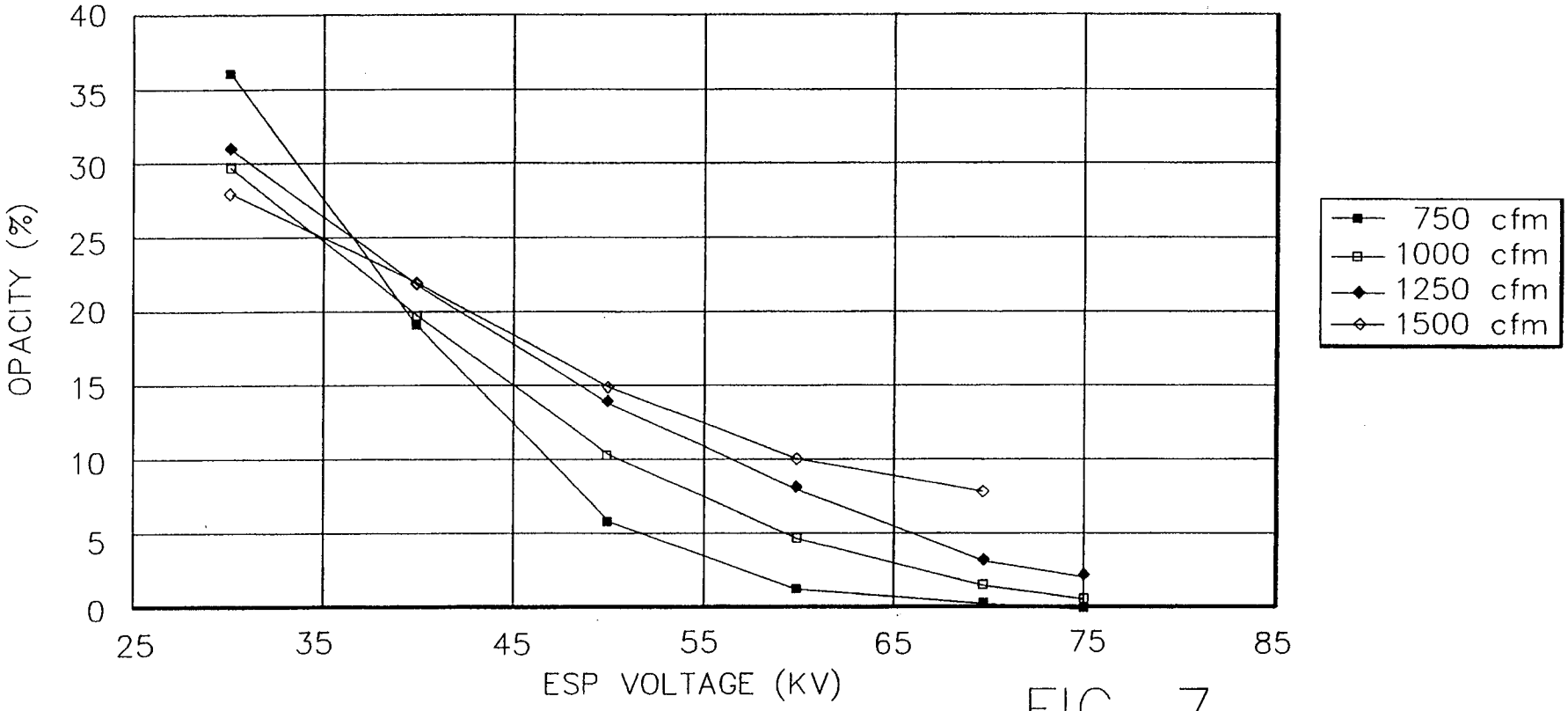
FIG. 7 is a graph showing opacity as a function of collection gap voltage for four different flue gas flow rates for a 16 inch diameter collector tube, an 8 inch diameter collector electrode, and 6 inch diameter ionizing disks.

FIG. 7 shows the average opacity level data as a function of collector gap voltage for each different flow rate. As expected, opacity decreased with increasing voltage and decreasing flew rate. Also, generally the larger diameter ionizer disks improved efficiency of the assembly compared to that of Examples 1 and 2.

The foregoing examples are illustrative of the present invention, and are not to be construed as limiting thereof. The invention is defined by the following claims, with equivalents of the claims to be included therein.

That which is claimed is:

1. An electrostatic precipitator unit comprising:

(a) tubular collection means having an inner surface and a longitudinal axis;

(b) an electrode suspended within said tubular collection means comprising:

(i) a substantially cylindrical collector portion having an upper end, a lower end, a longitudinal axis substantially parallel to said longitudinal axis of said collection means, and a circumferential outer surface, the collector portion being sized so that suspension thereof within said collection means creates a first gap between said inner surface of said collection means and said outer surface of said collector portion, the minimum width of said first gap defining a first distance;

ii) a transition region having an upper end and a lower end, said upper end being attached to said collector portion lower end, said transition region gradually decreasing in cross-section from said upper end to said lower end; and (iii) a charging portion comprising (A) a rod attached to said lower end of said transition region extending substantially parallel to said longitudinal axis of said collection means said rod having an outer surface, the maximum distance across said outer surface being less than the maximum distance across said collection portion outer surface; and (B) disk means attached substantially normally to said rod having a peripheral edge, said disk means being sized so that suspension of said charging portion within said collection means creates a second gap between said peripheral edge and said inner surface of said collection means, the minimum width of said second gap defining a second distance, said second distance being substantially as great or greater than said first distance; and (c) power means operably coupled with said electrode for establishing an electrical potential difference across said first gap and said second gap.

2. An electrostatic precipitator according to claim 1, wherein said longitudinal axis of said collection means, said longitudinal axis of said collector portion, and said rod are substantially coaxial.

3. An electrostatic precipitator according to claim 1, wherein said inner surface of said collection means is substantially cylindrical.

4. An electrostatic precipitator according to claim 1, wherein said disk means comprises a plurality of disks.

5. An electrostatic precipitator according to claim 4, wherein each of said plurality of disks is circular.

6. An electrostatic precipitator according to claim 5, wherein each of said plurality of disks has a second diameter, and said collector portion has a first diameter, and the ratio of the size of said second diameter to the size of said first diameter is between about 0.75:1 and 1:1.

7. An electrostatic precipitator according to claim 1, wherein said peripheral edge of said disk means is tapered as it extends radially outwardly.

8. An electrostatic precipitator according to claim 1, wherein said power means is configured to create an electrical potential difference between about 10,000 and 25,000 volts per inch of width in said first gap.

9. An electrostatic precipitator according to claim 1, wherein said first gap is between about 1.5 and 5 inches.

10. An electrostatic precipitator according to claim 1, wherein said outer circumferential surface has a diameter of between about 1.5 inches and 9 inches.

11. An electrostatic precipitator according to claim 1, wherein said transition region is tapered from said upper end to said lower end.

* * * * *

UNITED STATES PATENT AND TRADEMARK OFFICE
CERTIFICATE OF CORRECTION

PATENT NO. : 5,395,430

DATED : March 7, 1995

INVENTOR(S) : Dale A. Lundgren, et al.

It is certified that error appears in the above-identified patent and that said Letters Patent is hereby corrected as shown below:

Column 1 line 23, "See, e.g.," should be --See, e.g.,--;
line 50, "crosssections" should be --cross-sections--.

Column 3 line 6, "60" should be --60,--;
line 29, "39" should be --39,--.

Column 4 line 33, after "5 inches" start new paragraph.

Column 6 line 4, after "tubes" insert --30.--;
line 28, "4" should be --41--.

Column 7 line 39, "flew" should be --flow--.

Column 8 line 3, "ii)" should be --(ii)--

UNITED STATES PATENT AND TRADEMARK OFFICE

CERTIFICATE OF CORRECTION

PATENT NO. : 5,395,430
DATED : March 7, 1995
INVENTOR(S) : Dale A. Lundgren, et. al.

It is certified that error appears in the above-indentified patent and that said Letters Patent is hereby corrected as shown below:

Column 8 line 3, "ii)" should be --(ii)--.

Signed and Sealed this

Twentieth Day of June, 1995

Bruce Lehman

*Attest:*

BRUCE LEHMAN

*Attesting Officer*

*Commissioner of Patents and Trademarks*